United States Patent [19]

Priest et al.

[11] Patent Number: 4,897,052

[45] Date of Patent: Jan. 30, 1990

[54] INTERMEDIATE ELECTRICAL COMPONENT FOR A MOLDED PLUG

[75] Inventors: James D. Priest; Douglas D. Duffield, both of New Paris, Ohio

[73] Assignee: Cooper Industries, Inc., Houston, Tex.

[21] Appl. No.: 306,518

[22] Filed: Feb. 3, 1989

[51] Int. Cl.[4] ..... H01R 4/66

[52] U.S. Cl. ..... 439/652

[58] Field of Search ..... 439/650–652, 439/695–697

[56] References Cited

U.S. PATENT DOCUMENTS 2,641,745 6/1953 Harpster ..... 439/652

3,076,077 1/1963 Lindeman ..... 439/652

3,668,779 6/1972 Turner .

4,043,630 8/1977 Suverison et al. .

4,398,785 8/1983 Hedrick .

4,405,194 9/1983 van Lierop .

*Primary Examiner*—Joseph H. McGlynn

*Attorney, Agent, or Firm*—Fitch, Even, Tabin & Flannery

[57] ABSTRACT

An intermediate electrical component for an electrical connector has a body portion and a cap portion interfitted therewith. A plurality of terminal elements having stranded conductors connected to them are positioned in the body portion and substantially enclosed by the cap portion to prevent strays from escaping from the body portion and the cap portion.

11 Claims, 4 Drawing Sheets

INTERMEDIATE ELECTRICAL COMPONENT FOR A MOLDED PLUG

BACKGROUND OF THE INVENTION

The invention relates in general to electrical cord sets. In particular, the invention relates to an electrical cord set constructed in part from an intermediate electrical component or a pre-mold pod for a molded plug which prevents stray strands from stranded conductors from being exposed from a finished plug.

One of the significant expenses associated with the manufacture of electrical cord sets is the cost of molding the electric plug. In part, this is because in typical prior art molded plugs the interior of the plug, with the exception of the metallic terminals comprising the contact blades and ground prongs and the single conductors connected thereto, was completely filled with plastic or rubber which made the plugs relatively expensive. In addition, because of the relatively large volume of material molded in the plug it was difficult to obtain a smooth and aesthetically pleasing surface on the outer portion of the plug. In order to reduce the cost associated with the manufacture of cord sets, others have developed pre-molds or pre-mold pods consisting of multiple plastic components having a ground prong and power blades as well as singles connected thereto. Unfortunately, one of the problems associated with plug manufacture in the past which does not appear to have been significantly alleviated by the use of pre-molds is the problem of strays. Strays are strands of multiple strand conductors which are separated from strands connected to the crimped termination of a ground prong or a connector blade. In part, in order to avoid the problem of strays, pre-molds have been used in an attempt to trap all of the strays entirely within the pre-mold. However, many of the prior art pre-molds suffer from the problem that the strays are still long enough to exit a portion of the pre-mold due to relatively short spans between the crimped termination areas and the openings in the pre-mold from which the strays might exit.

The prior art also teaches the use of molded preforms which are assembled with electrical connectors and wires before a further molding step. For instance, U.S. Pat. No. 3,668,779 to Turner discloses, in FIG. 4, a pre-mold insert 21 having various recesses for receiving a pair of terminals 11 joined to stranded conductors 12. The mold itself receives the terminals 11 with the insert being positioned over the conductors with barrier walls 25 and 25*a* of the insert spacing the stranded conductors 12 to prevent shorting by a loose strand. The outer covering or post-mold is then molded about the insert. This insert is only a base and the mold itself performs the function of the lid to complete the encirclement of the stranded conductors.

U.S. Pat. No. 4,405,194 to van Lierop discloses a pre-mold insert arrangement including a base 3 holding space connector pin 7. A cap 1 covers the rear of the base 3 after attachment of the stranded conductors to the pin 7. The base has a recess 19 for receiving a fuse holder 5. The cap 1 prevents liquid plastic from flowing into the fuse recess 19 during injection molding of the plug body 25, as may best be seen in FIG. 2.

U.S. Pat. No. 4,043,603 to Suverison, et al. discloses a molded plug connection including a preformed insert 22, as may best be seen in FIGS. 2 through 6. The insert is described at column 2, lines 18 through 29. It includes a front plate 40 with a turret 42 extending rearwardly therefrom and having spaced wire-receiving channels 46. The channels 46 are open for most of the length of the insert 22.

U.S. Pat. No. 4,398,785 to Hedrick discloses an inner body 42 which is injection-molded about the contacts 12 and the connectors 14 which are attached to the contacts 12. Thereafter, an outer cover 50 is injection-molded about the inner body 42.

Although these pre-molds provide convenient intermediate electrical components for assembly of electrical plugs they do not prevent stray strands from extending from the finished plug. What is needed is an intermediate electrical component for a plug of a cord set which prevents stray conductor strands from exiting the plug surface where they might cause a shock hazard.

SUMMARY OF THE INVENTION

The instant inventive intermediate electrical component provides a number of solutions to the aforementioned problems. The intermediate electrical component comprises a two-piece insulating shell having an inter-fitting cap portion and body portion receiving the terminal elements comprising the power blades and the ground prong. The power blades and the ground prong are connected to a power cord having a plurality of single insulated stranded conductors. The single insulated stranded conductors, also known as singles, are crimped to the terminal elements. The body portion receives the terminal elements in a plurality of channels formed therein. The intermediate electrical component may be assembled by holding the terminal elements and single connectors in a jig and inserted them into the channels of the body portion. The cap portion may then be closed snugly over the body portion, thereby holding the singles and the metallic terminal elements for subsequent molding of the plug post-mold thereabout. The crimped-on connectors of the terminal elements are allowed to extend relatively far into the receiving channels in the body portion so that they are separated from a cord aperture by a distance greater than the average distance of the exposed strands from the single conductors. This prevents any exposed strands from exiting the cord aperture in the post-mold where they might present a shock hazard.

In an alternative construction of the intermediate electrical component, the cap portion substantially overlaps the body portion so that stray strands which might exit the body portion are trapped between the overlying cap portion and body portions which form a tortuous path and prevent a shock hazard to a user.

The intermediate electrical component in addition, provides a space-filling pod which substantially reduces the amount of plastic material which need be molded around the intermediate electrical component to form the finished plug.

In order to provide the aforementioned advantages an intermediate electrical component for an electrical connector has a plurality of terminal elements, each of which has a stranded connector connected to it. A two-piece insulating shell having a first body portion having a plurality of parallel channels formed therein, receives the terminal elements through a loading opening oriented transversely to the parallel channels. A second body portion encloses the terminal element loading opening in the first body portion, and has channels formed therein for receiving portions of the terminal elements extending from the first body portion.

It is a principal aspect of the present invention to provide an intermediate electrical component for an electrical connector which prevents stray strands from being exposed from a finished plug and prevents a shock hazard.

It is another aspect of the present invention to provide an intermediate electrical component for an electrical connector which may be quickly and easily assembled.

Other aspects and advantages of the present invention will become obvious to one skilled in the art upon a perusal of the following specification and claims in light of the accompanying drawings.

DETAILED DESCRIPTION OF THE PREFERRED EMBODIMENTS

Figure 1:
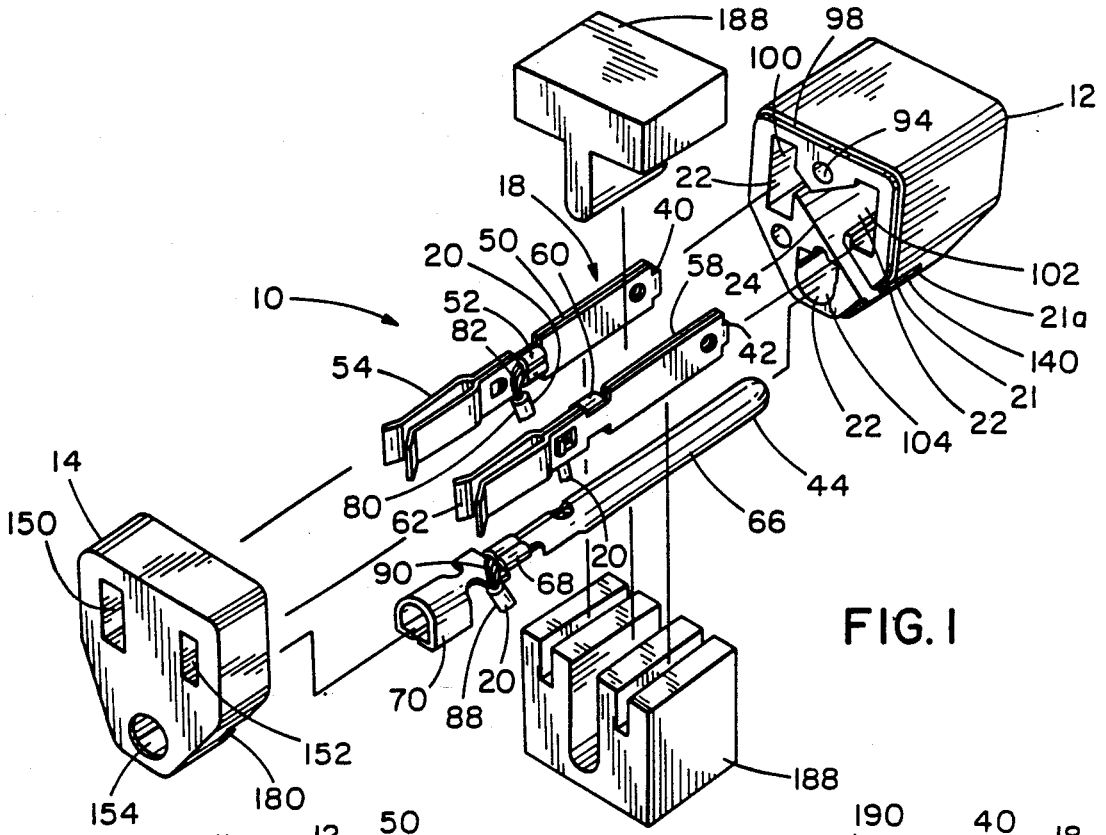
FIG. 1 is an exploded isometric view of an intermediate electrical component for a plug of a cord set embodying the present invention.
Figure 2:
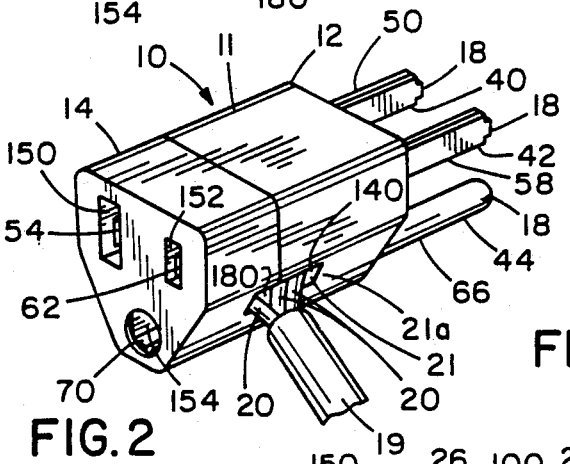
FIG. 2 is an isometric view of the electrical component of FIG. 1 showing the connection of a cord thereto.

Referring now to the drawings and especially to FIGS. 1, 2, 4 and 5, an intermediate electrical component for an electrical connector embodying the present invention and generally referred to by numeral 10 is shown therein. The intermediate electrical component 10 has a two-piece plastic insulating shell 11 having a first molded body portion 12 for receiving a plurality of terminal elements and a molded second or cap portion 14 for enclosing the terminal partially within body portion 12 and the cap portion 14. The cap portion 14 is slidably interfitted with the body portion 12. A plurality of terminal elements 18 comprise a pair of power blades for receiving electrical power from an conventional electric outlet and a ground prong for grounding of a device at the electric outlet. A power cord 19 having a plurality of single stranded conductors 20, which are also known as singles, is connected to the intermediate electrical component 10 by crimping the singles 20 to the terminal elements 18 to electrically connect the device to the terminal elements 18. The power cord 20 exits the insulating shell 11 at a feed-through aperture 21 which terminates at an external feed-through face 21*a*. The crimped terminal elements 18 are received in a plurality of channels 22 formed in the body portion 12. The channels 22 are oriented substantially parallel to one another to receive the terminal elements 18 easily in a single movement. A terminal element loading face 24 is positioned at one end of the each of the channels 22 and oriented transversely to them in order to receive the terminal elements 18. The cap portion 14 has a plurality of corresponding channels or cavities 26 arranged in registration with the channels 22 to receive and enclose portions of the terminal elements 18 extending from the body portion 12.

Referring now to FIG. 1, the terminal elements 18 include a power blade 40, a power blade 42 and a grounding prong 44. The power blades 40 and 42 are substantially identical. The power blade 40 includes a blade section 50, a crimp-on connector 52 and a pair of resilient leaves 54. The blade section 50 is adapted to be received in a standard electrical socket. The crimp-on connector 52 engages the single 20 in good electrical connection and the resilient sections 54 are adapted to receive a blade in piggyback connection therewith. Similarly, the blade 42 includes a blade section 58, a crimp-on connector 60 connected in good electrical connection to a single 20 and a pair of resilient leaves 62 for receipt of another power blade. The grounding prong 44 may be received in a standard grounding prong outlet at a tubular section 66 and has a crimp-on connector 68 formed integrally therewith. A substantially D-shaped prong receiving section 70 is formed integrally with the crimp-on connector 68 and may receive another grounding prong in piggyback connection therewith. The crimp-on connector 52 is connected to a single 80 at a stripped stranded portion 82. A single connector 84 having a stripped stranded portion 86 is connected at the stripped portion 86 to the crimp-on connection 60. A single connector 88 having a stripped stranded portion 90 is connected at the stripped stranded portion 90 to the crimp-on connector 68. The body portion 12 also has a pair of alignment apertures 94 and 96 formed therein and extending inwardly to receive mating pins on the cap 14 during assembly. A shoulder 98 is adapted to engage sealingly a part of the cap portion 14.

The body portion 12, as stated above, has three parallel channels 22. A first channel 100 is substantially rectangular in cross section and receives the power blade 40. A second channel 102, is also substantially rectangular in cross section and receives the power blade 42. A third channel 104, which is somewhat rounded, receives the ground prong 44. The channels 100, 102, and 104 terminate at the terminal element loading face 24. A substantially triangular wedge-shaped deflector wall 110 having a deflector surface 112 separates portions of the channels 100 and 102 and aligns the power blades 40 and 42 when they are introduced into the body portion 12. The wedge-shaped deflector wall 110 terminates at a pair of stops 118 and 120 which are positioned to abut the crimp-on connectors 52 and 60 of the blades 40 and 42 in order to prevent them from being forced out of the body 12 when the power blades 40 and 42 are assembled with the body 12. The channel 104 also includes a stop 130 for receiving in forcible engagement a portion of the grounding prong 44 to prevent it from extending farther than the outside of the body 12. The stops 118, 120 and 130 are positioned at a distance greater than the average stray strand length from a cord aperture 140 formed in the body portion 12 and comprising part of the feed-through aperture 21.

The cap portion 14 has the cap channels 26 formed therein which include a channel 150 which receives the spring blades 54, a channel 152 receiving the spring blades 62 and a circular channel 154 receiving the prong connector 70. The cap portion 14 also has an integral lip portion 160 formed therewith which mates with the shoulder 98 in good interfitting engagement with the body portion 12. In addition, the alignment apertures 94 and 96 of the body portion 12 receive a pair of mating pins 162 and 164 formed integrally with the cap portion 14 to assist in assembly. A cord aperture 180 comprising a part of the feed-through aperture 21 allows the power cord 19 to exit the insulating shell 11.

It may be appreciated that the intermediate component 10 may be quickly and easily assembled. The power blades 40, 42 and the grounding prong 44, after having been connected to their respective single connectors 80, 84 and 88, may be held by a suitable jig or fixture 188 and inserted into the body portion channels 100, 102 and 104. The jig 188 may then be removed and since the blades 40, 42 and grounding prong 44 are held in alignment by the body portion 12, the cap portion 14 may be slid into engagement with the body portion 12 substantially enclosing it and portions of the terminal elements 18 therein. The singles 20 within the power cord 19 then exit through the aperture 21 comprised of the cord aperture 140 in the body portion 12 and the cord aperture 180 in the cap portion 14.

Figure 3:
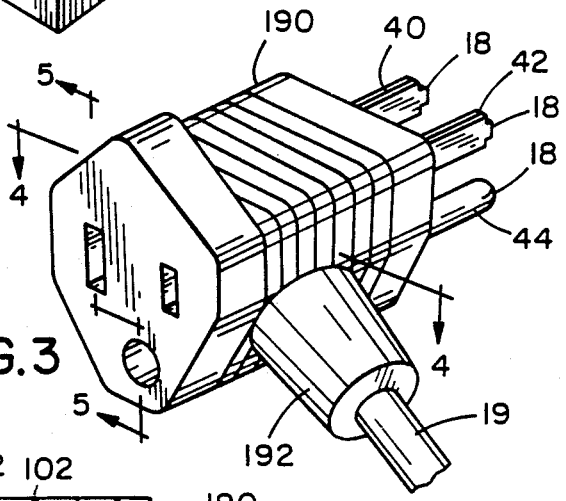
FIG. 3 is an isometric view of a portion of completed cord set showing details of the exterior of a post-mold of the plug.
Figure 4:
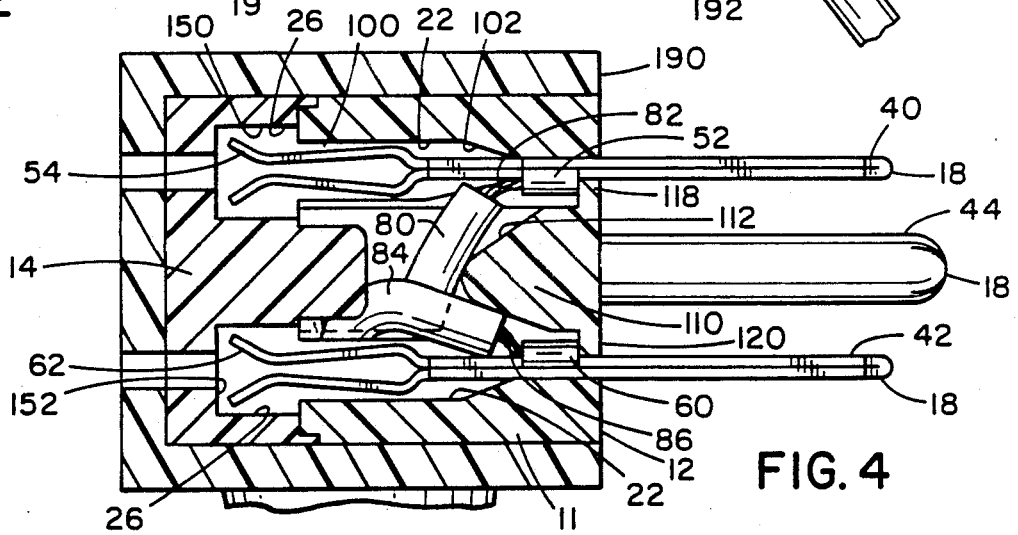
FIG. 4 is a section taken substantially along line 4—4 of FIG. 3 and showing details of the interior arrangement of the intermediate electrical component and the electrical connectors therein.
Figure 5:
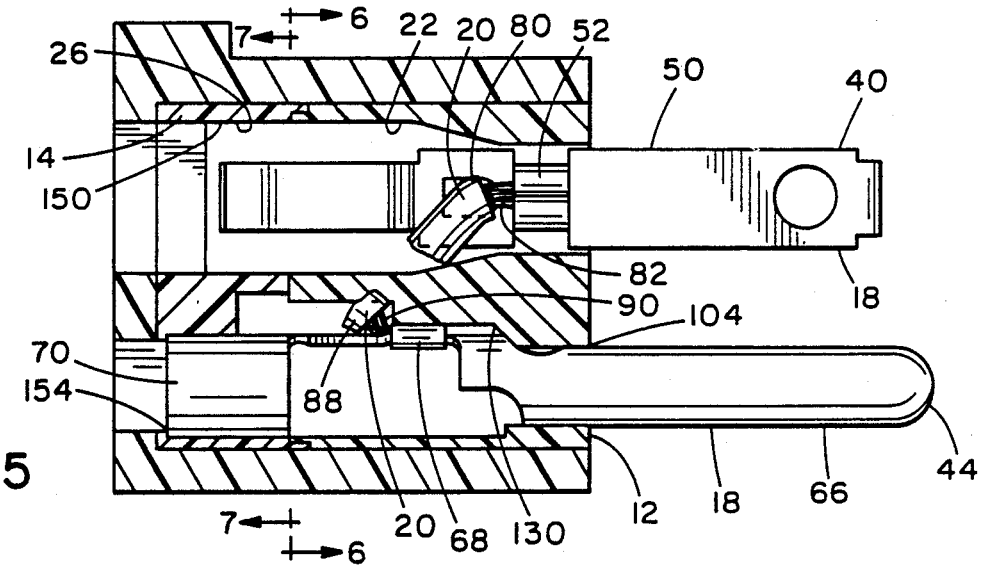
FIG. 5 is a section taken substantially along line 5—5 of FIG. 3 showing further details of the interior of the assembled plug.
Figure 6:
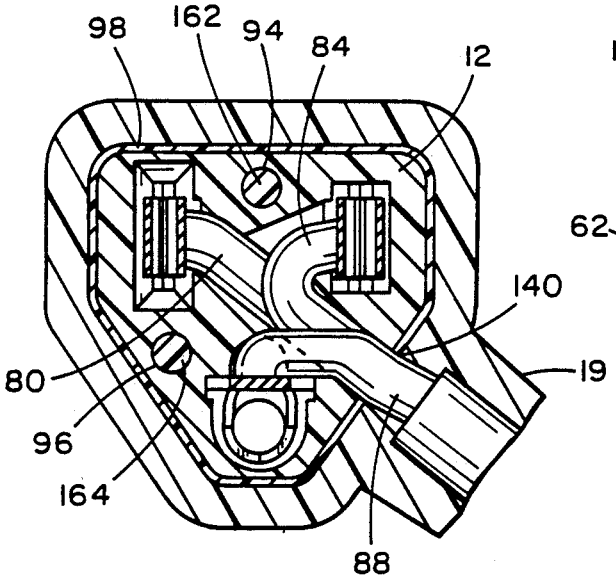
FIG. 6 is a section taken substantially along line 6—6 of FIG., 5 showing additional details of the interior of the completed post-mold.
Figure 7:
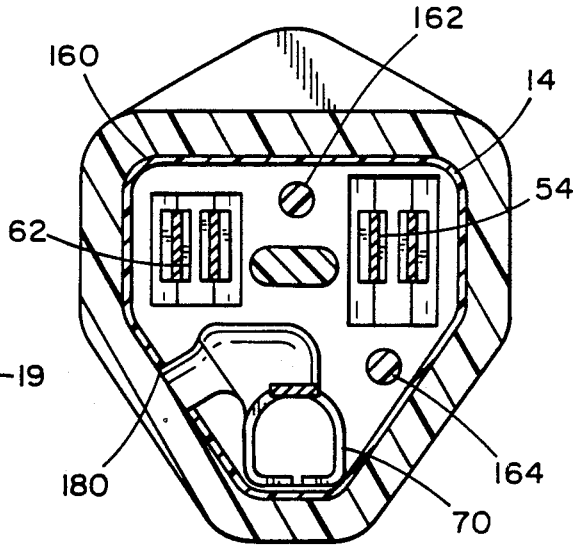
FIG. 7 is a section taken substantially along line 7—7 of FIG. 5 showing details of the interior of the completed post-mold.
Figure 8:
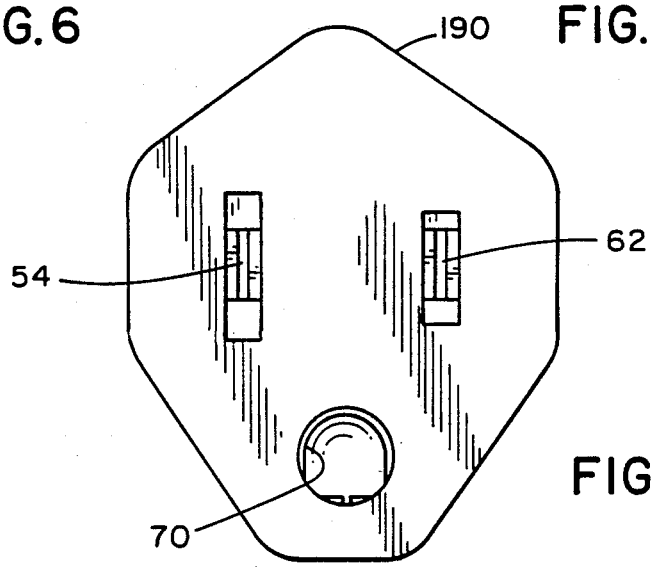
FIG 8 is a side elevation of the post-mold of FIG. 3.
Figure 9:
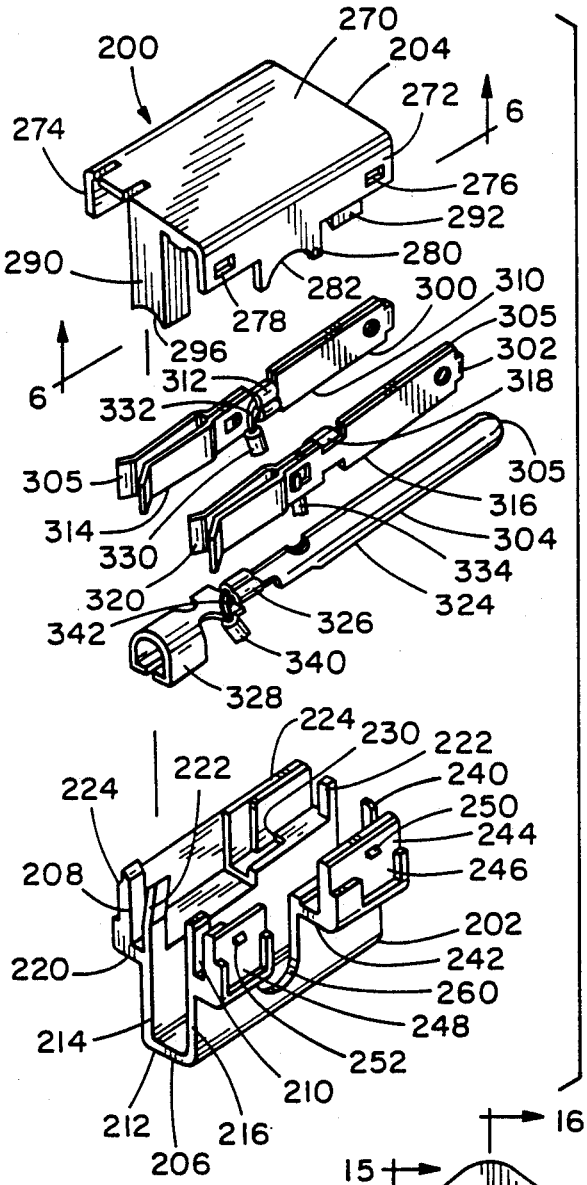
FIG. 9 is an exploded isometric view of an alternative embodiment of embodying the present invention.
Figure 10:
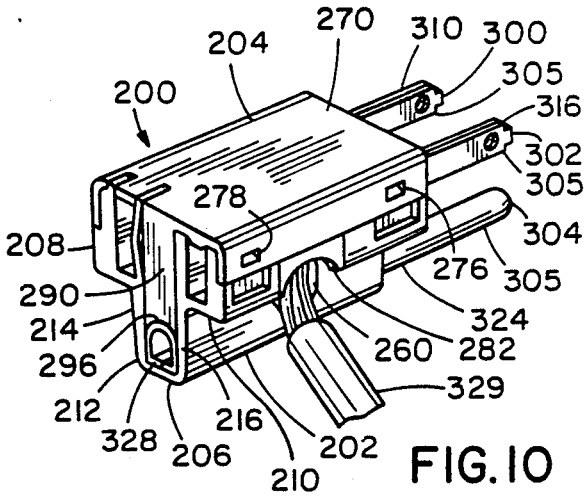
FIG. 10 is an isometric view of the intermediate electrical component of FIG. 9 having power blades and a ground prong therein as well as a plurality of single power conductors extending therefrom.
Figure 11:
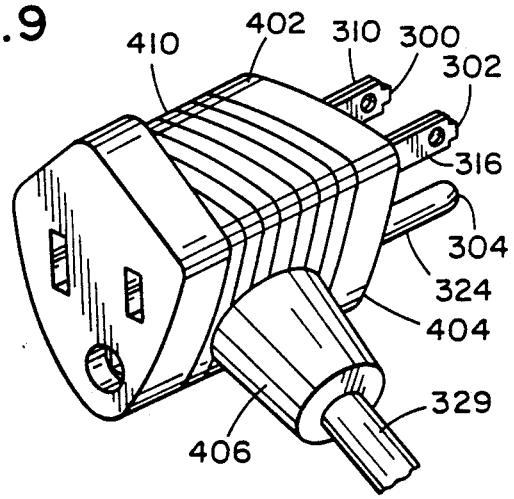
FIG. 11 is a isometric view of a post-mold formed about the pre-mold of FIG. 10.
Figure 12:
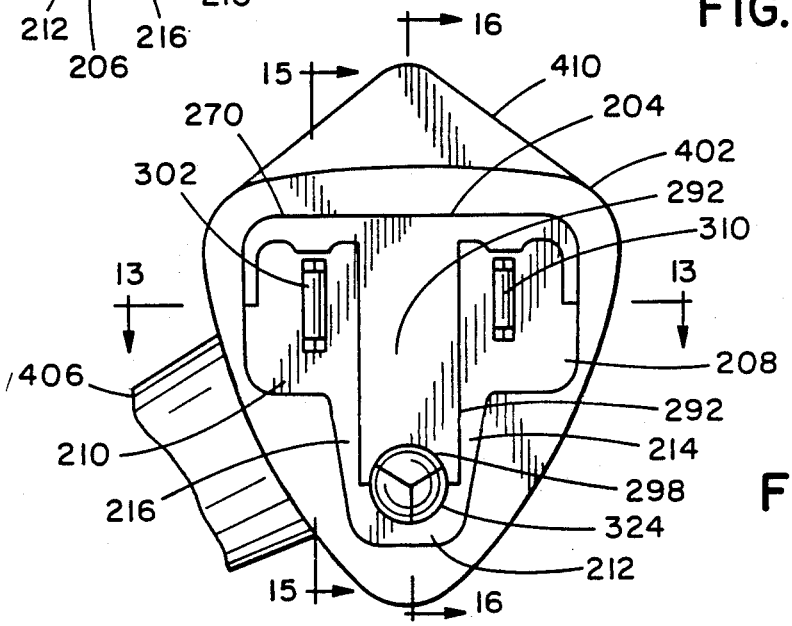
FIG. 12 is an end elevation of the post-mold of FIG. 11.
Figure 13:
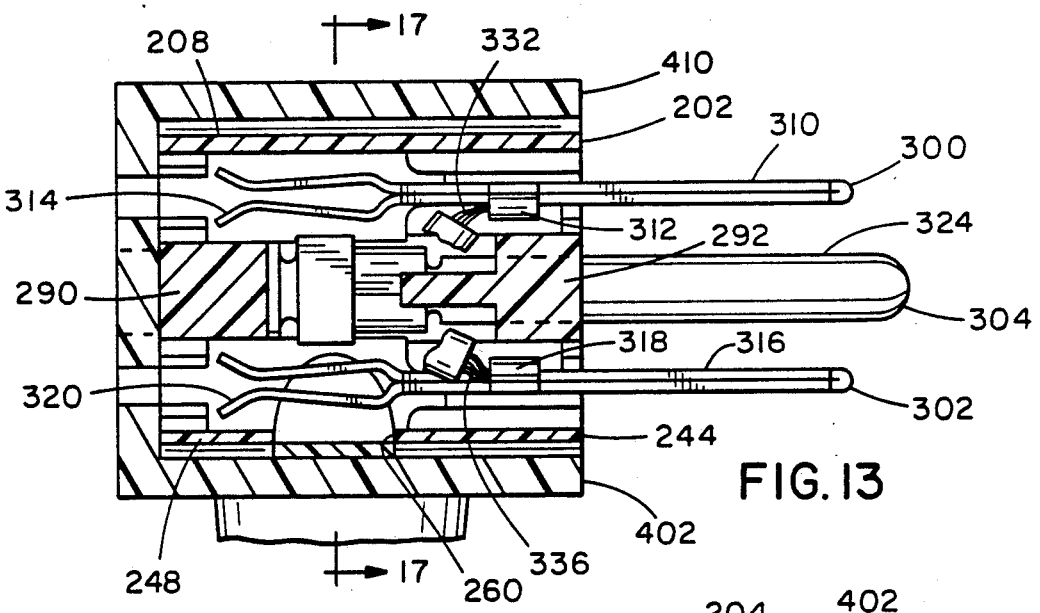
FIG. 13 is a section taken substantially along line 13—13 of FIG. 12 showing details of the interior of the completed plug.
Figure 14:
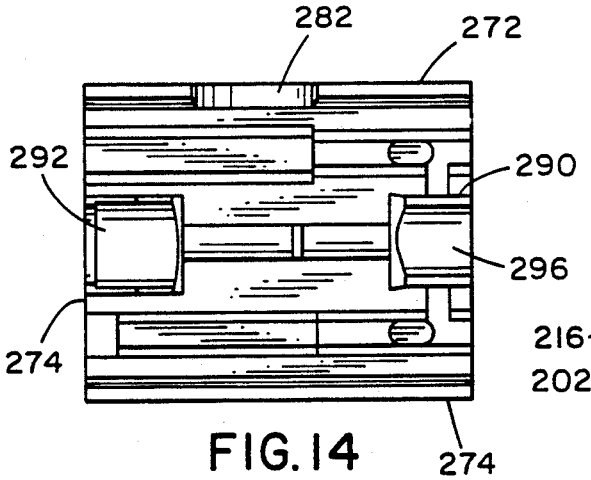
FIG. 14 is an elevation of a cap portion of the pre-mold.
Figure 15:
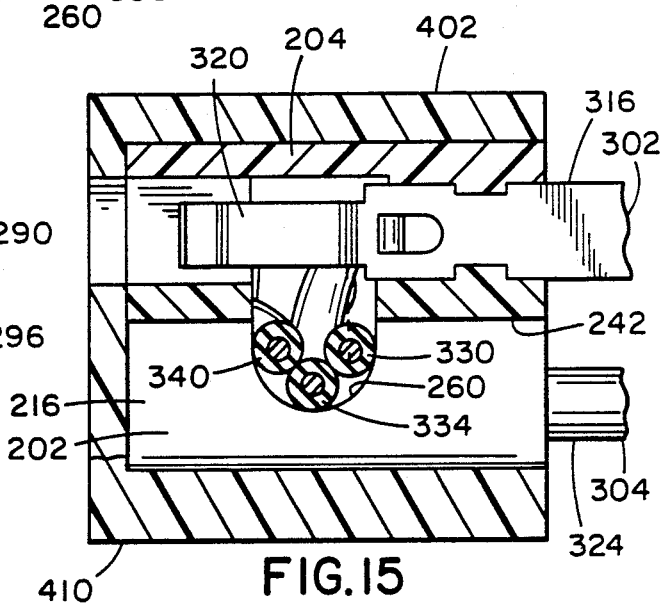
FIG. 15 is a section taken substantially along line 15—15 of FIG. 12.
Figure 16:
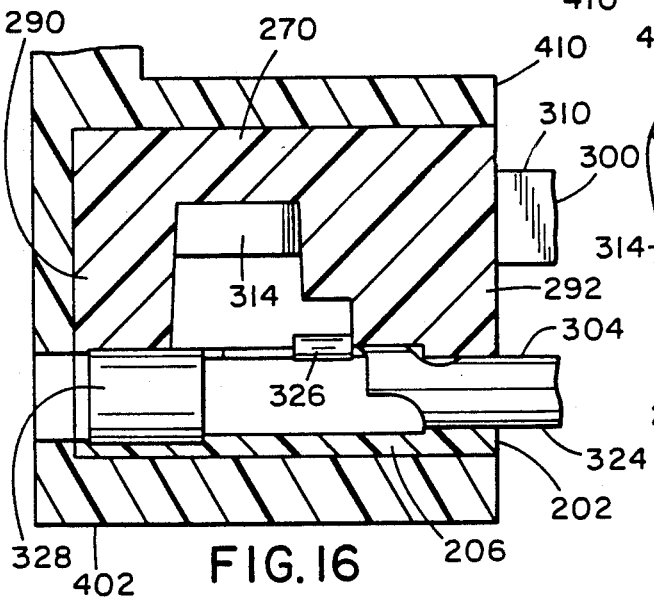
FIG. 16 is a section taken substantially along line 16—16 of FIG. 12.
Figure 17:
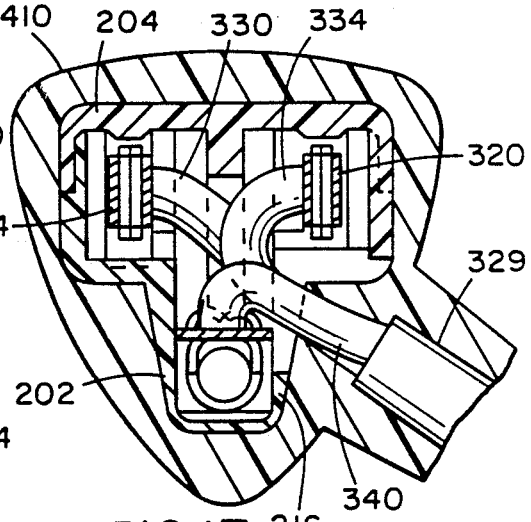
FIG. 17 is a section taken substantially along line 17—17 of FIG. 13.

The completed intermediate component 10 may then be placed in a suitable mold and have a plastic material molded thereabout to complete a post-mold 190 or completed plug as may best be seen in FIGS. 3 and 8. The post-mold 190 includes a strain relief 192 connected to the power cord 19.

In an alternative embodiment, an intermediate electrical component 200, as may best be seen in FIGS. 9 through 17, has a two-piece plastic insulating shell 201 having a molded plastic body portion 202 and a molded plastic cap portion 204. The body portion 202 includes a ground prong channel portion 206, a first power blade channel portion 208, and a second power blade channel portion 210. The ground prong channel portion 206 consists of a bottom wall 212, a first side wall 214 and a second side wall 216. The first power blade channel 208 is formed integrally with the side wall 214. The second power blade channel 210 is formed integrally with the side wall 216. The first power blade channel 208 includes a laterally extending bottom wall 210, an inner wall 222 and an outer wall 224. The inner wall 222 extends directly from the wall 214. The outer wall 224 is formed integrally with the bottom wall 220. Likewise, the second power blade channel 210 has an interior wall 240, a bottom wall 242, and an exterior wall 244. The exterior wall 244 includes a forward portion 246 and a rearward portion 248. The forward portion 246 and the rearward portion 248 each have a respective wedge-shaped snap, respectively numbered 250 and 252, and positioned thereon for locking engagement with a part of the cap portion 204. The forward portion 246 and the rearward portion 248 are separated by a U-shaped cord opening 260 which is a feed-through aperture for a power cord, as will be seen in more detail hereafter.

The cap 204 includes a top wall 270, a first side wall 272 and a second side wall 274. The side wall 272 includes a snap aperture 276 and a snap aperture 278 formed therein. A leg 280, having an arcuate surface 282 formed therein, extends downwardly from the top wall 270 and is oriented in registration with the arcuate opening 260 when the intermediate component 200 is assembled. A rearward ground prong leg 290 and a forward ground prong leg 292 are formed integrally with the top wall 270. The grounding prong leg 290 terminates at an arcuate surface 296. The grounding prong leg 292 terminates at an arcuate surface 298. The arcuate surfaces 296 and 298 engage and hold a ground prong immobile in the ground channel 206.

A pair of power blades 300 and 302 and a grounding prong 304 comprise a plurality of terminal elements 305. The power blade 300 includes a blade section 310, a crimp-on connector 312 and a pair of spring leaves 314 for electrical connection to another power blade. The power blade 302 includes a blade 316, a crimp-on connector 318 and a pair of spring leaves 320 for electrical connection to another power blade. The grounding prong 304 includes a cylindrical prong 324, a crimp-on connector 326 and a semicircular prong receiving element 328. A power cord 329 having a single stranded conductor 330 having a stripped stranded portion 332 is connected at the stranded portion 332 to the crimp-on connector 312. A single stranded conductor 334 having a stripped stranded portion 336 is connected at the stripped stranded portion 336 to the crimp-on connector 318. A single stranded conductor 340 having a stripped stranded portion 342 is connected at the stripped stranded portion 342 to the crimp-on connector 326.

The intermediate electrical component 200 may be assembled by first connecting the singles 330, 334 and 340 to the metallic terminal elements 300, 302 and 304, respectively. The ground prong 304 is then placed in the trough 206. The power blade 300 is placed in the trough 208, and the power blade 302 is placed in the trough 210. The cap portion 204 is then forced over the body portion 202 with the snap apertures 276 and 278 being brought into snap engagement with the wedges 250 and 252. It may be appreciated that the wall 272 and the wall 274 extend in an overlapping and close-fitting relationship with the outer walls 244 and 224 of the body portion 202 to define tortuous paths which prevent stray strands from the singles 330, 334 and 340 from exiting the intermediate electrical component 200. The singles 330, 334 and 340 extend into the power cord 329, which exits through the opening defined by the arcuate sections 260 and 282. Following assembly, the assembled intermediate component may then be placed in a mold and an outer covering 402 having a body portion 404 and a strain relief 406, is molded thereabout to complete a plug 410, as may best be seen in FIGS. 11, 12, 13, 15, 16 and 17.

It may be appreciated that the present intermediate electrical component provides an easy to assemble two-piece construction. It also effectively prevents stray strands from being exposed where they might present a shock hazard.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed is:

1. An intermediate electrical component for an electrical connector, comprising:

a plurality of terminal elements;

a stranded conductor connected to each of the terminal elements;

a first body portion having a plurality of parallel channels formed therein, and a terminal element loading face oriented transversely with respect to the parallel channels, each channel receiving one of the terminal elements; and a second body portion closing the terminal element loading opening and having channels formed therein and aligned with corresponding channels of the first body portion for receiving portions of the terminal elements extending from the first body portion.

2. An intermediate electrical component for an electrical connector as defined in claim 1, wherein the first body portion further comprises an internal wall separating two of the channels from another of the channels for isolating a pair of the terminal elements for carrying line current from a terminal element for grounding.

3. An intermediate electrical component for an electrical connector as defined in claim 1, wherein the first body portion further comprises a pair of alignment apertures formed therein and located in proximity with the terminal loading opening and extending inwardly into the body portion and the second body portion further comprises a pair of alignment pins for insertion in the alignment apertures of the first body portion to hold the second body portion in registration with the first body portion.

4. An intermediate electrical component for an electrical connector as defined in claim 1, wherein the first body portion further comprises a wedge-shaped deflector wall positioned between two of the channels to aid in the insertion of the terminal elements into the channels.

5. An intermediate electrical component for an electrical connector as defined in claim 1, wherein the first body portion further comprises a stop in each of two of the channels which engages a connector component on the terminal element and a feed-through aperture having an external feed-through face for entry of the stranded conductors, the external feed-through face being spaced from each of the stops by respective distances longer than a length of the conductive strands exposed for contact with the terminal elements to prevent stray conductive strands passing through the feed-through aperture.

6. An intermediate electrical component for an electrical connector as defined in claim 1, wherein the first body portion further comprises a feed-through aperture having an external feed-through face and formed in a side portion of the body portion for entry of the stranded conductors.

7. An intermediate electrical component for an electrical connector as defined in claim 6, wherein the first body portion further comprises a plurality of terminal access openings formed therein to allow an electrical connection with the terminal elements.

8. An intermediate electrical component for an electrical connector, comprising:

a plurality of terminal elements;

a stranded conductor connected to each of the terminal elements and having a plurality of conductive strands;

a first body portion having a bottom wall, a first lower side wall connected to the bottom wall and a second lower side wall connected to the bottom wall opposite the first lower side wall, the lower side walls extending substantially the entire height of the intermediate electrical component, a plurality of parallel channels formed within the bottom wall and the lower side walls, each of the parallel channels receiving one of the terminal elements therein; and a second body portion having a top wall and a pair of upper side walls connected thereto, the second body portion enclosing the parallel channels and having the upper side walls extending in substantial overlapping relation and contact with the lower side walls to define a long tortuous path for preventing the conductive strands from being exposed.

9. An intermediate electrical component for an electrical connector as defined in claim 8, wherein the second body portion comprises a snap connecting cap.

10. An intermediate electrical component for an electrical connector as defined in claim 9, wherein the cap includes a leg for holding one of the terminal elements in contact with the bottom wall of the first body portion.

11. A method of assembling a two-piece electrical component for an electrical connector, comprising the steps of:

placing a plurality of terminal elements in a jig;

guiding the jig and terminal elements into contact with a first body portion;

removing the jig; and substantially enclosing the terminal elements with a second body portion brought into connection with the first body portion.

* * * * *